United States Patent [19]

Kush et al.

[11] Patent Number: 4,477,287

[45] Date of Patent: Oct. 16, 1984

[54] LIQUID REMOVAL DEVICE

[75] Inventors: Donald C. Kush, Pleasanton; Gary A. Hust, Livermore, both of Calif.

[73] Assignee: Kaiser Aluminum & Chemical Corporation, Oakland, Calif.

[21] Appl. No.: 464,818

[22] Filed: Feb. 8, 1983

[51] Int. Cl.³ ..... B08B 5/00; B08B 5/04; B21B 45/02

[52] U.S. Cl. ..... 134/15; 15/345; 72/39; 72/40; 134/21; 134/32; 134/37

[58] Field of Search ..... 134/15, 21, 32, 37; 15/345, 346; 72/39, 40

[56] References Cited

U.S. PATENT DOCUMENTS

| | | | |
|---|---|---|---|
| 2,018,791 | 10/1935 | Kern | 15/345 |
| 2,055,577 | 9/1936 | Huff | 15/345 |
| 2,181,487 | 11/1939 | Khuen-Kryk | 15/345 |
| 3,192,752 | 7/1965 | Dowd et al. | 72/45 |
| 3,221,358 | 12/1965 | Dickson | 15/345 X |
| 3,374,118 | 3/1968 | Seress et al. | 15/345 X |

FOREIGN PATENT DOCUMENTS

| | | | |
|---|---|---|---|
| 474628 | 8/1969 | Switzerland | 15/345 |

*Primary Examiner*—Marc L. Caroff

*Attorney, Agent, or Firm*—John S. Rhoades

[57] ABSTRACT

This invention relates to an improved method and device for removing liquid from a moving surface such as a continuous metal sheet or strip. The invention has particular application to the removing of lubricant and/or coolant from sheet or strip in a rolling operation or the backup rolls of the rolling mills. The invention comprises a vacuum unit to remove most of the liquid from the moving surface, an air knife to drive the liquid remaining on the surface toward the vacuum unit, and a vent maintained at a pressure intermediate between the low pressure of the vacuum unit and the high pressure of the air knife to minimize eddy current formation in the gas flow from the air knife to the vacuum unit. Eddy currents can cause the redeposition of liquid onto the essentially dry sheet or strip.

17 Claims, 6 Drawing Figures

LIQUID REMOVAL DEVICE

BACKGROUND OF THE INVENTION

Figure 1:
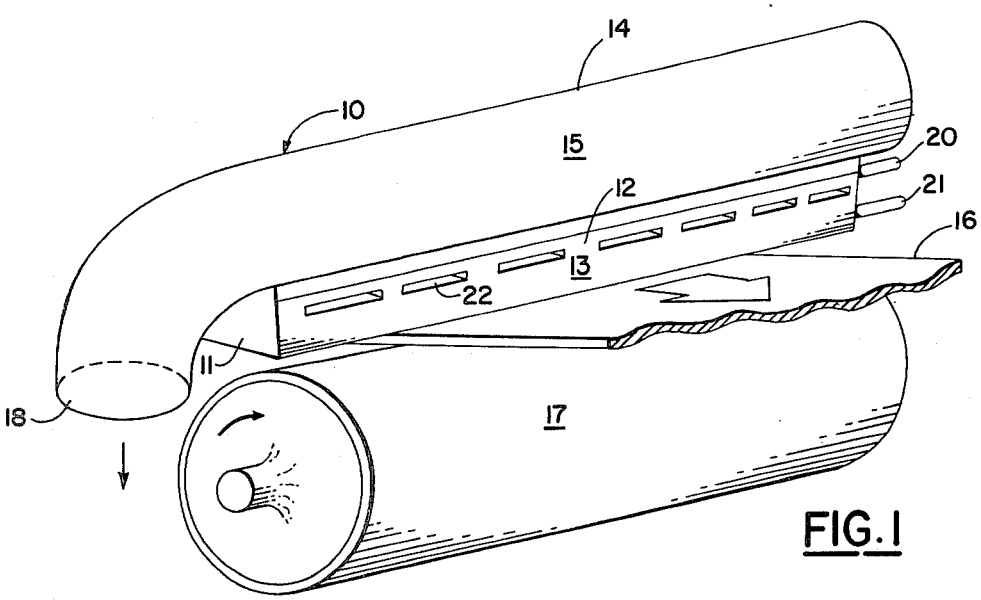

This invention relates to an improved method and device for removing liquid and the like from a moving surface, such as in process lines which manufacture or treat continuous flat rolled products or strip.

Many methods and devices have been employed to remove liquids and particulate matter from the surfaces of continuous sheet or strip and other moving surfaces including those based on vacuum and those based on jets or curtains of high velocity gas, commonly called air knives. Such devices and methods have been used in rolling mills to remove lubricant and/or coolant from the sheet or strip being rolled and also in other process lines, such as in painting, anodizing, or plating lines to remove liquids.

Each of the prior liquid removal devices has both advantages and disadvantages. For example, vacuum devices can effectively remove the liquid from a moving sheet or strip under conditions where the liquid is uniformly distributed over the sheet or strip surface, provided that the speed of the sheet or strip is slow enough and the volume of induced air is large enough to ensure entrainment of all the free liquid and the complete evaporation of any moisture remaining on the sheet or strip. However, large surges of liquid on the sheet or strip tend to overwhelm vacuum systems so that the liquid is not completely removed. Air knives, which are based on high velocity jets or a curtain of gas, can be very effective liquid removing devices, even with large surges of liquid, but these devices have a tendency to blow the liquid removed from the sheet or strip into the surrounding environment where it can impinge or condense upon associated equipment and ultimately drip back upon the surface of the strip or sheet, thereby requiring further treatment.

Liquid removal devices which employ both vacuum units and air knives such as those described in U.S. Pat. No. 3,192,752 have been somewhat more successful, particularly in rolling mill operations, but these, too, also seem to provide less than adequate removal of liquid from the moving sheet or strip, particularly at the high speeds commonly found in modern rolling mills, e.g., 3000–5000 feet per minute (914–1524 meters per min.). Even though vacuum units are employed, a fine mist frequently builds up in the immediate vicinity of the rolling mill and liquid which redeposits or condenses on strip may require further treatment of the sheet or strip.

In the treatment of aluminum and aluminum alloy sheet or strip wherein the liquid on the aluminum sheet or strip is water or a water-based fluid, additional problems are encountered because water rapidly reacts with fresh aluminum surfaces to form a white oxide product commonly termed "water stain". Water stain formation is particularly noticeable in the rolling of aluminum with waterbased lubricants if all of the aqueous phase of the lubricant is not removed from the strip before coiling.

The modern, high speed rolling mills presently used to cold roll aluminum and aluminum alloys have the capability of speeds up to 5000 feet per minute (1524 meters per minute) or more. At speeds of this magnitude, the effectiveness of the liquid removal device becomes most important because frequently the maximum speed at which the rolling mill may be effectively operated is severely reduced by the inability of the liquid removal device to keep the surface of the strip or sheet free from aqueous phase after rolling.

It is against this background that the present invention was developed.

DESCRIPTION OF THE INVENTION

This invention relates to an improved method and device for removing liquid and other material from a moving surface, such as continuous sheet or strip in a rolling mill or other process line or the backup or work rolls of a rolling mill.

In accordance with the invention, liquid on a moving surface is removed by a two-stage operation. The first stage is a partial vacuum or aspirating means which removes the bulk of the liquid and the second stage is an air knife or means for generating a high velocity gas curtain or stream which removes any remaining liquid or moisture from the moving surface and directs the removed liquid toward the vacuum stage. Additionally, a gas supply means is provided between the two stages which has one or more conduits at gas pressures intermediate between the less than atmospheric pressure of the vacuum unit and the greater than atmospheric pressure of the air knife. This gas stream is a dry air stream which is entrained into the gas curtain of the air knife. This prevents eddy current formation which can entrain liquid laden gases into the gas curtain of the air knife and thereby cause the redeposition of liquid onto the dry sheet. A vent to atmosphere has been found to be adequate to provide the required intermediate pressure.

The first stage or partial vacuum unit has one or more conduits with operative openings which are disposed immediately adjacent to the wet moving surface and which extend across the width thereof. The operative openings may be a series of holes or slots or a single slot across the width of the moving surface. The pressure in the conduit(s) is maintained at substantially less than atmospheric pressure so that the gas flow induced by the partial vacuum is sufficient to aspirate the bulk or most of the liquid from the moving surface as it passes the vacuum unit.

The second stage is an air knife which provides a curtain of high velocity gas across the width of the surface and generally perpendicular thereto so that upon impact a large portion of the high velocity gas is redirected generally parallel to the sheet or strip surface, countercurrent to the relative movement thereof, and toward the vacuum unit. This contained, high velocity gaseous stream passing parallel but countercurrent to sheet or strip movement drives essentially all of the remaining liquid on the sheet or strip surface into the area between the two stages so the partial pressure of the vacuum unit can remove the accumulated liquid. Although the gas curtain can be tilted at small angles toward the vacuum unit, the most efficient liquid removal is obtained with the gas curtain perpendicular to the surface of the sheet or strip.

Between the vacuum means and the means generating the high velocity gas curtain, one or more intermediate conduits are provided in which the gas pressure therein is maintained at a level less than the gas pressure of the means generating the gas curtain but greater than the gas pressure at the conduits in the vacuum unit. These intermediate conduits are most conveniently vented to the atmosphere. The dry gas which passes through the intermediate conduits and becomes entrained in the gas curtain prevents the formation of eddy currents in the liquid laden gaseous stream moving toward the vacuum unit which can intermix the liquid ladened gas with the relatively dry gas in the high velocity gas curtain and thereby redeposit liquid back onto the sheet or strip.

The liquid removal device is positioned closely to the moving surface with the spacing between the bottom surface of the liquid removal device and the sheet or strip surface generally being less than one-tenth of an inch (2.54 mm), preferably from about 0.005 to about 0.075 inch (0.127 to 1.905 mm). To avoid marring the surface preferably no contact is made between the liquid removing device and the wet moving surface. In removing liquid from sheet or strip the close positioning of the device should be effected by means which are separate from the sheet or strip.

The distance between the conduit(s) of the air knife and the conduit(s) of the vacuum unit of the liquid removal device is less than one inch because at greater distances the liquid removing effectiveness of the device is greatly reduced.

In process lines for continuous sheet and strip liquid removal devices will be positioned adjacent to both the top and bottom surfaces of the sheet or strip and relatively close to one another in the process line so that no liquid is carried over the edge from one side of the sheet or strip to the other. For accurate positioning of the liquid removal device with respect to the sheet or strip, it is preferred to direct the continuous sheet or strip over (or under) an idler or billy roll to stabilize the sheet or strip and position the coolant removal device immediately adjacent the area where the strip contacts the roll. Enough tension is applied to the sheet or strip to remove any unflatness in the sheet or strip as it passes over the roll. The angle of wrap of the sheet or strip around the idler roll periphery is not critical so long as the placement of the sheet is proper. Wrap angles of 5° have been found suitable.

In the rolling of metallic sheet and plate with water-based, oil-in-water emulsions utilized as lubricant-coolants, the liquid removal device of the invention removes essentially all of the water based liquid on the sheet or strip and it also advantageously leaves on the sheet a very thin, water-free layer of oil phase from the emulsion. This thin layer of oil phase has been found very useful in protecting the sheet or strip from corrosion during transportation and storage and also in the application of other lubricants to the surface in the subsequent fabrication of the sheet or strip into other products such as can bodies and lids. Of course, care must be exercised in the selection of the oil phase components to be sure that the thin layer of oil base material which remains on the sheet or strip is of a desired composition. Usually, only the more viscous and less volatile lubricant components of the oil phase will remain in this thin oil based layer.

Figure 2:
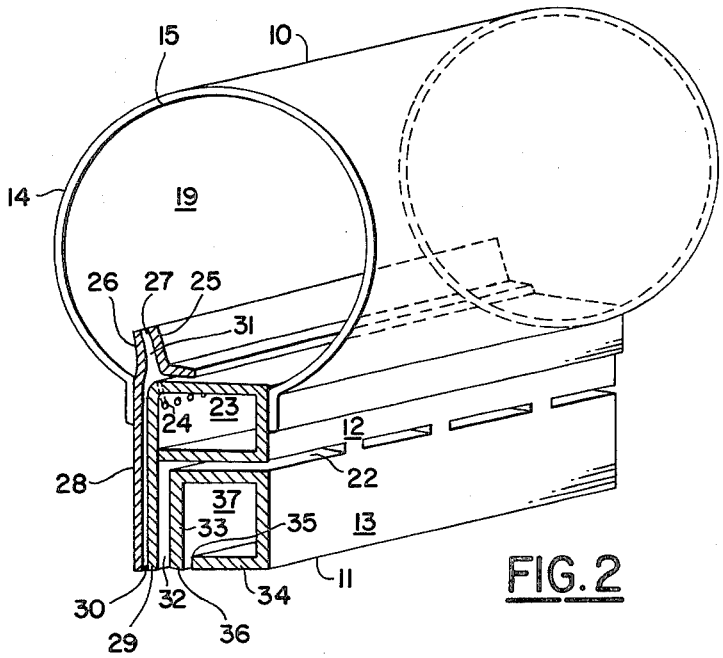
Figure 3:
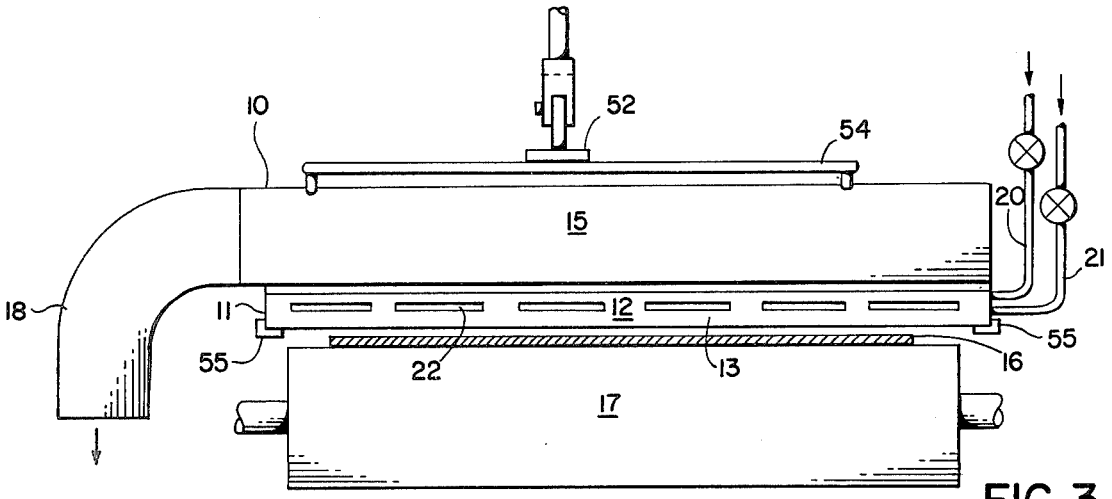
Figure 4:
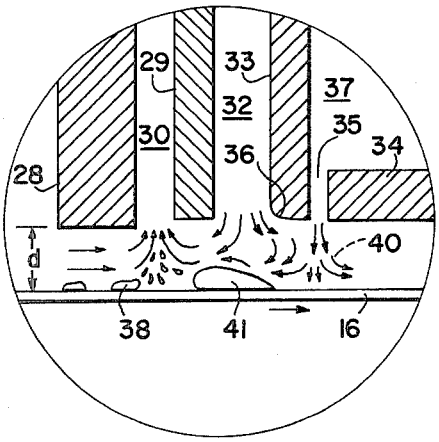
Figure 5:
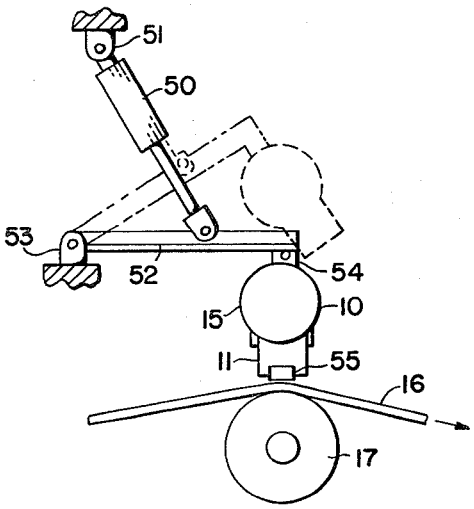
Figure 6:
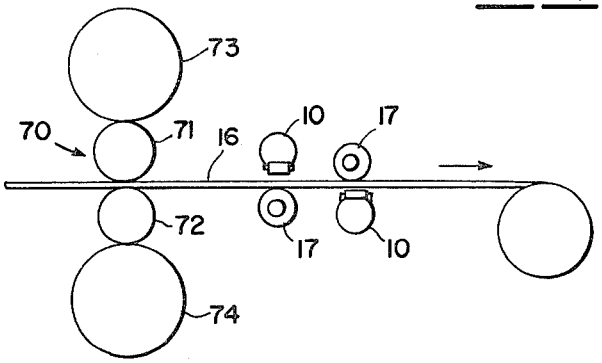

Reference is made to the drawings which illustrate a preferred embodiment of the invention. In the drawings, all corresponding parts are numbered the same. FIG. 1 is a perspective view of the liquid removal device of the invention. FIG. 2 is a perspective, cross sectional view of a segment of the device shown in FIG. 1. FIG. 3 is an elevation view of the liquid removal device. FIG. 4 is an enlarged cross sectional view of the lower segment of the liquid removal device showing the several gaseous streams and the liquid removal operation of the device. FIG. 5 illustrates a mechanism for positioning the liquid removal device adjacent the sheet or strip. FIG. 6 illustrates use of the liquid removal devices on the top and bottom of sheet or strip exiting from a rolling mill.

With specific reference to FIGS. 1–4, the liquid removal device 10 comprises a lower section 11 containing the vacuum unit 12 and air knife unit 13 and an upper section 14 comprising an exhaust manifold 15. The liquid removal device 10 is positioned closely adjacent to the sheet or strip 16 which travels over an idler or billy roll 17 to eliminate vertical movement of the sheet or strip so that the accurate placement of the liquid removal device close to the sheet or strip can be maintained. The exhaust manifold 15 is provided with an exhaust conduit 18 for gas and liquid discharge from the inner chamber 19. The vacuum unit 12 is supplied with high pressure gas from line 20 and the air knife unit 13 is supplied with high pressure gas from line 21.

The inner details of the lower section 11 and the upper section 14 are best shown in FIG. 2 which is a perspective view of a segment of the liquid removal device shown in section. The vacuum unit 12 of section 11 is an elongated generally rectangularly shaped hollow member attached to the exhaust manifold 15 and it has an inner chamber 23 which is in fluid communication with the inner chamber 19 of exhaust manifold 15 through conduits 24 and baffles 25 and 26 which extend into the chamber 19 and form a slot 27. The air or other gas which passes from chamber 23 through the throat 31 defined by baffles 25 and 26 and into chamber 19 creates the partial vacuum in conduit 30 required to remove liquid from the surface. The baffles 25 and 26 extend into chamber 19 to keep the liquid which is aspirated through conduit 30 into the exhaust chamber 19 from interfering with the gas flow from chamber 23 through conduits 24 and slot 27. Baffle 26 extends downwardly and forms the front wall 28 of the lower section 11. The front wall 28 and inner wall 29 which depend from the lower portion of vacuum unit 12 form a slot 30 which is in fluid communication with the inner chamber 19 of exhaust manifold 15. Depending wall 29 forms a slot 32 with the wall 33 of air wipe unit 12 which is in fluid communication with vents 22 open to the atmosphere. Air knife unit 13 is an elongated, generally rectangularly shaped hollow member positioned beneath the vacuum unit 12. Walls 33 and 34 form a gap 35 which directs a curtain 40 of high velocity gas (shown in FIG. 4) from the inner chamber 37 of the air knife unit 13 perpendicular to the sheet or strip 16. The lower surface 36 of wall 33 is inclined in the direction of the depending wall 29 with an inclination angle of 5° to 20° from the horizontal so that surface 36 forms an expanding chamber with the moving surface 16.

FIG. 4 is an enlarged cross sectional view of the lower part of section 11 positioned closely adjacent the sheet or strip 16 which more clearly illustrates the operation of the liquid removal device 10 of the invention. The distance between the sheet or strip 16 and the liquid removal device 10 is less than 0.1 inch, and preferably ranges from about 0.005 to 0.075 inch (0.127–1.905 mm). A negative pressure with respect to atmospheric pressure or partial vacuum is generated in slot 30 by the high velocity gas passing through the conduits 24 of vacuum unit 12 and the slot 27 and then expanding into chamber 19 of exhaust manifold 15. The vacuum induced gas flow removes most of the liquid shown as droplets 38 on sheet or strip 16 as the strip or sheet moves under slot 30.

Air passes from the chamber 37 of air knife unit 13 as a high velocity curtain 40 generally perpendicular to the travelling sheet or strip 16. Part of the curtain of air 40 is redirected generally parallel to the strip or sheet 16 but in the opposite direction of strip or sheet travel (shown by the arrow) and passes slot 32 drawing in dry air. The parallel air flow also drives the remainder of any liquid from the surface of sheet or strip 16 into an accumulation or puddle 41 and toward the vacuum slot 30. The dry gas which is aspirated or otherwise passes through slot 32 eliminates eddy current formation between slot 30 and slot 35. Eddy currents can cause the liquid ladened air or mist to be recycled back into the curtain of air 40 whereby entrained liquid can be redeposited onto the surface of the sheet or strip 16. Usually a puddle or bead of liquid 41 accumulates on the sheet or strip 16 between slots 30 and 32 and liquid from this accumulation is aspirated into slot 30 and then on to chamber 19.

An apparatus is shown in FIGS. 3 and 5 for placing the liquid renoval device 10 adjacent to the sheet or strip 16 which comprises a hydraulic or pneumatic cylinder 50 supported from element 51 at one end and connected to inverted T-member 52 at the other end. The inverted T-member 52 is connected at one end to support element 53 and on the other end is connected by means of bracket 54 to the liquid removal device 10. Stop elements 55 supported by means not shown are provided to stop the coolant removal device 10 a desired distance from the moving surface 16.

FIG. 6 shows the liquid removing device 10 of the invention on the exit end of a rolling mill 70 comprising work rolls 71 and 72 and backup rolls 73 and 74. The rolling mill illustrated could be a single stand mill or the last stand of a multistand rolling mill. At the feed end of the rolling mill 70 coolant is sprayed onto the surface of the strip or sheet 16 and the backup and work rolls 71–74. After passing through the work rolls 71 and 72, the sheet or strip 16 has liquid deposited on the surface and the wet sheet or strip 16 is directed over two relatively closely spaced idler rolls 17 which eliminate vertical movement of the sheet or strip 16 so that the liquid removal devices 10 can be disposed closely to the top and bottom surfaces of the sheet or strip 16. The sheet or strip is under sufficient tension to eliminate unflatness in the sheet or strip as it passes over the idler roll 17. After passing over the last idler roll 17, the essentially dry sheet or strip 16 can be coiled as shown.

The liquid removal device of the present invention can be readily supplied with compressed air or other gases through conduits 20 and 21 from sources normally found in most industrial plants. However, precautions should be taken to ensure that the compressed gas supplied to the unit is clean and reasonably dry so that the various conduits and slots of the coolant removal device through which the gas streams pass are not plugged and that no liquid is applied to the sheet or strip 16. Gas pressures from about 20 up to 120 psi or more can be used in the present device but conventional plant air pressure of about 60 psi has been found to be most convenient.

The liquid removal device of the invention was tested to determine various operating parameters when effectively removing liquid from sheet travelling at speeds from 2000 to 4000 feet per minute (609–1219 meters per minute). The results are given in the table below. The distance is the distance between the sheet surface and the liquid removal device. The air wipe pressure is the pressure measured in the gas supply chamber 37 in the drawings and the eductor pressure is the pressure in chamber 19 in the drawings. The air wipe discharge slot (slot 35 in drawings) was 0.01 inch (0.0254 cm) wide, the vacuum slot (slot 30 in drawings) was 0.188 inch (0.478 cm) wide and the vent opening (slot 32 in drawings) was 0.15 inch (0.381 cm) wide.

| | Air Wipe | | Eductor | |
|---|---|---|---|---|
| Distance from Sheet | Pressure (psi) | Gas Flow (scfm) | Pressure (psi) | Gas Flow (scfm) |
| .02 | 5.0 | 15 | 10 | 24 |
| .04 | 7.5 | 33 | 7.5 | 21 |
| .06 | 7.5 | 33 | 10 | 24 |
| .08 | 12.5 | 45 | 28 | 39 |
| .10 | 20.0 | 57 | 90 | 92 |

The same device has been found to be suitable in removing liquids from sheet or strip travelling at speeds of 5000 feet per minute (1524 meters per minute).

Although the invention has been described herein primarily in terms of removing liquid from moving sheet or strip, it can be employed to remove liquid with equal effectiveness from moving surfaces such as other flat rolled products, backup and work rolls in rolling mills and pinch rolls and the like. Additionally, it is obvious that various modifications and improvements can be made to the present invention without departing from the spirit of the invention and the scope of the appended claims.

We claim:

1. A device for removing a liquid from a surface of a moving strip comprising means for moving the strip along a path in combination with:

(A) Partial vacuum-creating means disposed along the path of travel of the strip and across the width of and closely adjacent to the moving strip's surface for aspirating the bulk of the liquid from the strip's surface as it passes the partial vacuum-creating means;

(B) Other means disposed along the path of travel of the strip and across the width of the strip's surface and downstream from the partial vacuum-creating means for generating and directing perpendicular to the moving strip's surface a high velocity gas curtain which as it impinges on the moving strip's surface is redirected in substantial amounts countercurrent to the movement of the strip for removing the liquid remaining on the moving strip's surface and directing the remaining liquid to the partial vacuum-creating means; and (C) a confined flow dry gas supply means disposed between the partial vacuum-creating means and the gas curtain generating means and along the path of travel of the strip and across the strip's surface whereby gas from said confined flow dry gas supply means is introduced into the gas of the gas curtain at a pressure level that is intermediate that of the gas pressure in the partial vacuum-creating means and the gas pressure of the gas curtain.

2. The liquid removal device of claim 1 wherein the device is disposed at a distance less than 0.1 of an inch from the surface of the moving strip.

3. The liquid removal device of claim 1 wherein the device is disposed at a distance of about 0.005–0.075 of an inch from the surface of the moving strip.

4. A liquid removal device as set forth in claim 1 wherein said confined flow dry gas supply means is vented to the atmosphere.

5. A liquid removal device as set forth in claim 1 wherein a common wall means separates the partial vacuum-creating means from said dry gas supply means and a second common wall means separates the dry gas supply means from said gas curtain generating means.

6. A liquid removal device as set forth in claim 1 wherein the partial vacuum-creating means includes high velocity gas conduits and an expansion chamber.

7. A liquid removal device as set forth in claim 5 wherein the common wall between the dry gas supply means and the gas curtain generating means includes a lower surface inclined in the direction of the gas curtain generating means so as to form in conjunction with the surface of the moving strip an expanding chamber.

8. A method of removing a liquid from the surface of a moving strip comprising the steps of:

(A) Directing the moving strip having liquid on a surface thereof past and in close proximity to a liquid removing device disposed across the width of said strip;

(B) Establishing and maintaining across the width of the surface of the moving strip a partial vacuum through at least one slotted opening disposed across and adjacent the moving strip in order to aspirate and remove the bulk of the liquid on and from the surface of the moving strip;

(C) Next moving the strip past a curtain of a high velocity gas while directing said gas in the form of a curtain generally perpendicular to and across the width of the moving strip's surface so that a substantial portion of the perpendicularly directed gas curtain is redirected upon impact with the said strip's surface parallel thereto and countercurrent to the movement thereof to remove liquid remaining on the moving surface; and (D) During passage of said strip from said partial vacuum area to said curtain of high velocity gas preventing the formation of eddy currents in the high velocity gas curtain by establishing a controlled confined gaseous stream and introducing said stream into the gas of the gas curtain intermediate said partial vacuum area and said high velocity gas curtain and maintaining said gaseous stream at a pressure intermediate the pressure level of the gas in the partial vacuum area and the pressure level of the gas in the high velocity gas curtain.

9. The method of claim 8 wherein the moving strip surface is maintained at a distance of less than 0.1 of an inch from the liquid removing device as it moves past said device 10. The method of claim 8 wherein the liquid removing device is disposed at a distance of about 0.005–0.75 of an inch from the surface of the moving strip.

11. The method of claim 8 wherein the distance between the liquid removing device and the moving strip's surface is maintained by passing the strip at a selected angle over an endless surface located adjacent said liquid removing device.

12. In a rolling mill wherein a liquid removing device is located adjacent the discharge end of a mill stand for removing liquid from a moving flat rolled strip product as it exits from the discharge end of said mill stand said liquid removing device comprising the combination of:

(A) A partial vacuum-creating means disposed along the path of travel of the strip product and across the width of and closely adjacent a surface of the strip product for aspirating and removing the bulk of the liquid from the said surface of the strip product as it passes the partial vacuum-creating means;

(b) Means disposed along the path of travel of the strip and downstream from the partial vacuum-creating means and across the width of the said strip product for generating and directing perpendicular to said surface of the strip product a high velocity gas curtain which as it impinges upon the surface of the strip product is redirected in substantial amounts countercurrent to the strip product's movement for removing liquid remaining on the said surface of the strip product and for directing the remaining liquid on the said surface to the partial vacuum-creating means; and (C) A confined flow dry gas supply means disposed intermediate the partial vacuum-creating means and the gas curtain generating means said dry gas supply means introducing a dry gas into the gas of the gas curtain at a pressure level that is between the gas pressure level of the partial vacuum-creating means and the gas pressure level of the gas curtain generating means.

13. In a rolling mill as set forth in claim 12 including means for venting the confined flow dry gas supply means to the atmosphere.

14. A method of removing a liquid coolant from the surface of a moving flat rolled strip product as it exits from a discharge end of a rolling mill stand comprising the steps of:

(A) Directing the flat rolled strip having liquid disposed on the surface thereof past a liquid removal device disposed across the width of the surface of the strip;

(B) Establishing and maintaining across the width of the surface of the strip a partial vacuum through at least one slotted opening in the liquid removal device in order to aspirate and remove the bulk of the liquid on the strip surface through the slotted opening;

(C) Generating a curtain of a high velocity gas and then directing said curtain generally perpendicular to and across the width of the strip's surface so that a substantial portion of the perpendicularly directed gas curtain is redirected upon impact with the surface of the strip parallel thereto and countercurrent to the movement thereof to remove the remaining liquid from the strip's surface; and (D) Preventing the formation of eddy currents in the high velocity gas curtain by establishing and maintaining a controlled confined flow of a dry gas and introducing said dry gas flow into the gas of the gas curtain intermediate and adjacent both to the high velocity gas curtain and the partial vacuum opening at a pressure level that is between the pressure level of the gas in the partial vacuum opening and the gas pressure level of the gas curtain.

15. In a rolling mill as set forth in claim 12 including a common wall for said partial vacuum-creating means and said dry gas supply means.

16. In a rolling mill as set forth in claim 12 wherein said liquid removal device is disposed adjacent the bottom surface of the moving strip.

17. In a rolling mill as set forth in claim 12 wherein the liquid removal device is located adjacent the top surface of the moving strip.

* * * * *